US007896663B2

(12) United States Patent
Niidome et al.

(10) Patent No.: US 7,896,663 B2
(45) Date of Patent: Mar. 1, 2011

(54) PLUG ASSEMBLY, ATTACHMENT PLUG AND CONVERSION PLUG

(75) Inventors: Kuniharu Niidome, Tokyo (JP); Yuzuru Iijima, Tokyo (JP); Shugo Maruyama, Tokyo (JP)

(73) Assignee: Kaga Components Co., Ltd., Tokyo (JP)

( * ) Notice: Subject to any disclaimer, the term of this patent is extended or adjusted under 35 U.S.C. 154(b) by 0 days.

(21) Appl. No.: 12/648,844

(22) Filed: Dec. 29, 2009

(65) Prior Publication Data

US 2010/0190364 A1 Jul. 29, 2010

(30) Foreign Application Priority Data

Jan. 26, 2009 (JP) ..... 2009-014540

(51) Int. Cl.
*H01R 13/44* (2006.01)
*H01R 13/60* (2006.01)

(52) U.S. Cl. ..... 439/131; 439/172; 439/173

(58) Field of Classification Search ..... 439/131, 439/170–174, 518, 638
See application file for complete search history.

(56) References Cited

U.S. PATENT DOCUMENTS 5,613,863 A 3/1997 Klaus et al.
7,638,968 B2 * 12/2009 Inoue et al. ..... 320/107
2003/0068909 A1 4/2003 Su
2007/0046257 A1 3/2007 Inoue et al.

FOREIGN PATENT DOCUMENTS

EP 1220379 A2 7/2002
EP 1237234 A2 9/2002
JP 2007-052998 A 3/2007
JP 2008-153031 A 7/2008

OTHER PUBLICATIONS

European Search Report dated Jun. 2, 2010, issued in corresponding European Patent Application No. 10151131.9.

* cited by examiner

*Primary Examiner*—Javaid Nasri
(74) *Attorney, Agent, or Firm*—Westerman, Hattori, Daniels & Adrian, LLP

(57) ABSTRACT

A conversion plug has a pair of guide projections that hold therebetween a pair of blades in a stand state at the time of attachment of the conversion plug to an attachment plug, and guide the pair of blades into a pair of recesses. A plug main body has, at positions respectively adjacent to the pair of blades in the stand state, a pair of storage recesses for housing the pair of guide projections. During assembly, the pair of blades are naturally guided to the pair of recesses by the guide projections without an operator's specific care. After the assembly, the pair of blades are engaged in the pair of recesses and the guide projections are engaged in the storage recesses so that the guide projections cover the pair of blades thereby preventing the pair of blades from being deformed.

7 Claims, 12 Drawing Sheets

PLUG ASSEMBLY, ATTACHMENT PLUG AND CONVERSION PLUG

FIELD

The present invention is related to a plug assembly formed by an attachment plug and a conversion plug, and to the attachment plug and the conversion plug forming the plug assembly.

BACKGROUND

In the world, there are many kinds of outlets having different specifications, i.e., receptacles of different shapes. In a case where products for export are manufactured, each product is provided with a plug suitable for the specification of the product's destination, or each product is provided with a conversion plug as disclosed in U.S. Pat. No. 5,613,863 or Japanese Laid-open Patent Publication No. 2007-52998 at the time of shipment.

Here, when a plug manufacturer produces plugs, it is cost-effective to assemble: a plug suitable for the specification of one kind of outlet; and a conversion plug used as an adaptor of the plug and suitable for another kind of outlet, rather than separately producing each plug for the specification of a suitable outlet. This is because the attachment plug usually has various circuits including an AC-DC conversion circuit and an overcurrent prevention circuit and thus, in many cases, the cost as a whole is reduced by mounting such circuits on only an attachment plug of one kind and making a conversion plug serve only for the purpose of supporting an outlet of different specification.

Therefore, in such a system that a plug assembly is exported after being formed by securely coupling an attachment plug and a conversion plug to each other, the plug assembly can be provided at a lower cost.

Here, when forming a plug assembly composed of an attachment plug and a conversion plug, the following are important. Blades and the like to be inserted into an outlet should be protected from unintentional force applied thereto without, extra caution when the conversion plug is inserted into the attachment plug. Also, after the conversion plug is coupled to the attachment plug, the conversion plug and the attachment plug should be so integrated that there is no backlash or play between the coupled attachment plug and conversion plug, thereby preventing deformation of the blades.

SUMMARY

The present invention has been made in view of the above circumstances and provides a plug assembly having a structure in which blades are hardly deformed both during assembly and when in use and also provides an attachment plug and a conversion plug forming the plug assembly.

A plug assembly according to the present invention includes:

an attachment plug that includes a pair of blades projecting while facing each other and plugged in an outlet of a first specification, a plug main body having a storage channel for housing the pair of blades, and a blade support that supports one end of each of the pair of blades and is pivotably supported by the plug main body to rotate, along a plane including the pair of blades by approximately 90 degrees, between a stand state in which the pair of blades stand from the plug main body and a stored state in which the pair of blades are engaged in the storage channel; and a conversion plug that includes a plurality of insert projections plugged in an outlet of a second specification different from the first specification and a pair of recesses into which the pair of blades in the stand state are inserted, the insert projections carrying electricity received from the outlet of the second specification to the pair of blades when the pair of blades are inserted into the pair of recesses and, wherein the conversion plug further includes a pair of guide projections that hold therebetween the pair of blades in the stand state when the conversion plug is coupled to the attachment plug and guide the pair of blades into the pair of recesses, and wherein the plug main body has, at positions respectively adjacent to the pair of blades in the stand state, a pair of storage recesses for housing the pair of guide projections.

In the plug assembly according to the present invention, when an operator assembles a plug assembly by attaching a conversion plug to an attachment plug, the pair of guide projections hold therebetween the pair of blades and naturally guide them into the pair of recesses. Thus, at the time of assembly, the guide projections restrict a posture of the pair of the blades and prevent unnecessary force from being applied to the blades, thereby preventing deformation of the blades.

In addition, when in use, the guide projections are accommodated in the recesses and function as a protection wall by covering the blades. Thus, the blades are protected from possible impact caused by fall or collision, thereby preventing deformation of the blades when in use after assembly.

Here, preferably, the storage channel is also used as one of the pair of the storage recesses.

This additional feature simplifies the structure of the attachment plug of the plug assembly, which enables further reduction in cost.

Further, preferably, the conversion plug and the plug main body have a conversion-plug engagement section and a plug-main-body engagement section, respectively, which engage with each other when the conversion plug is coupled to the attachment plug.

According to this preferable feature, when the conversion plug is coupled to the attachment plug, the conversion plug and the plug main body of the attachment plug are securely connected to each other with the conversion-plug engagement section and the plug-main-body engagement section, so that a robust structure is achieved.

Also, the attachment plug of the plug assembly according to the present invention is an attachment plug that includes:

a pair of blades projecting while facing each other and plugged in an outlet of a first specification;

a plug main body having a storage channel for housing the pair of blades; and a blade support that supports one end of each of the pair of blades and is pivotably supported by the plug main body to rotate, along a plane including the pair of blades by approximately 90 degrees, between a stand state in which the pair of blades stand from the plug main body and a stored state in which the pair of blades are engaged in the storage channel, wherein the attachment plug is engaged with a conversion plug that has a plurality of insert projections plugged in an outlet of a second specification different from the first specification, a pair of recesses into which the pair of blades in the stand state are inserted, and a pair of guide projections that hold therebetween the pair of blades in the stand state when the conversion plug is coupled to the attachment plug and guide the pair of blades into the pair of recesses, and when the plurality of insert projections are plugged in the outlet of the second specification in a state in which the pair of blades are inserted into the pair of recesses, the insert projections carry electricity received from the outlet of the second specification to the pair of blades, and wherein the plug main body has, at positions respectively adjacent to the pair of blades in the stand state, a pair of storage recesses for housing the pair of guide projections.

Also, the conversion plug of the plug assembly according to the present invention is a conversion plug attached to an attachment plug that has a pair of blades projecting while facing each other and plugged in an outlet of a first specification, a plug main body having a storage channel for housing the pair of blades, and a blade support that supports one end of each of the pair of blades and is pivotably supported by the plug main body to rotate, along a plane including the pair of blades by approximately 90 degrees, between a stand state in which the pair of blades stand from the plug main body and a stored state in which the pair of blades are engaged in the storage channel, the conversion plug receiving electricity from an outlet of a second specification different from the first specification and carrying the electricity to the pair of blades, the conversion plug including:

a plurality of insert projections plugged in an outlet of a second specification different from the first specification, a pair of recesses into which the pair of blades in the stand state are inserted, and a pair of guide projections that hold therebetween the pair of blades in the stand state when the conversion plug is coupled to the attachment plug and guide the pair of blades into the pair of recesses.

As described above, the present invention is capable of realizing a plug assembly at a low cost having a structure in which blades are hardly deformed both during assembly and when in use and an attachment plug and a conversion plug forming the plug assembly.

DESCRIPTION OF EMBODIMENT

Hereafter, an embodiment of the present invention will be described with reference to the attached drawings.

Figure 1:
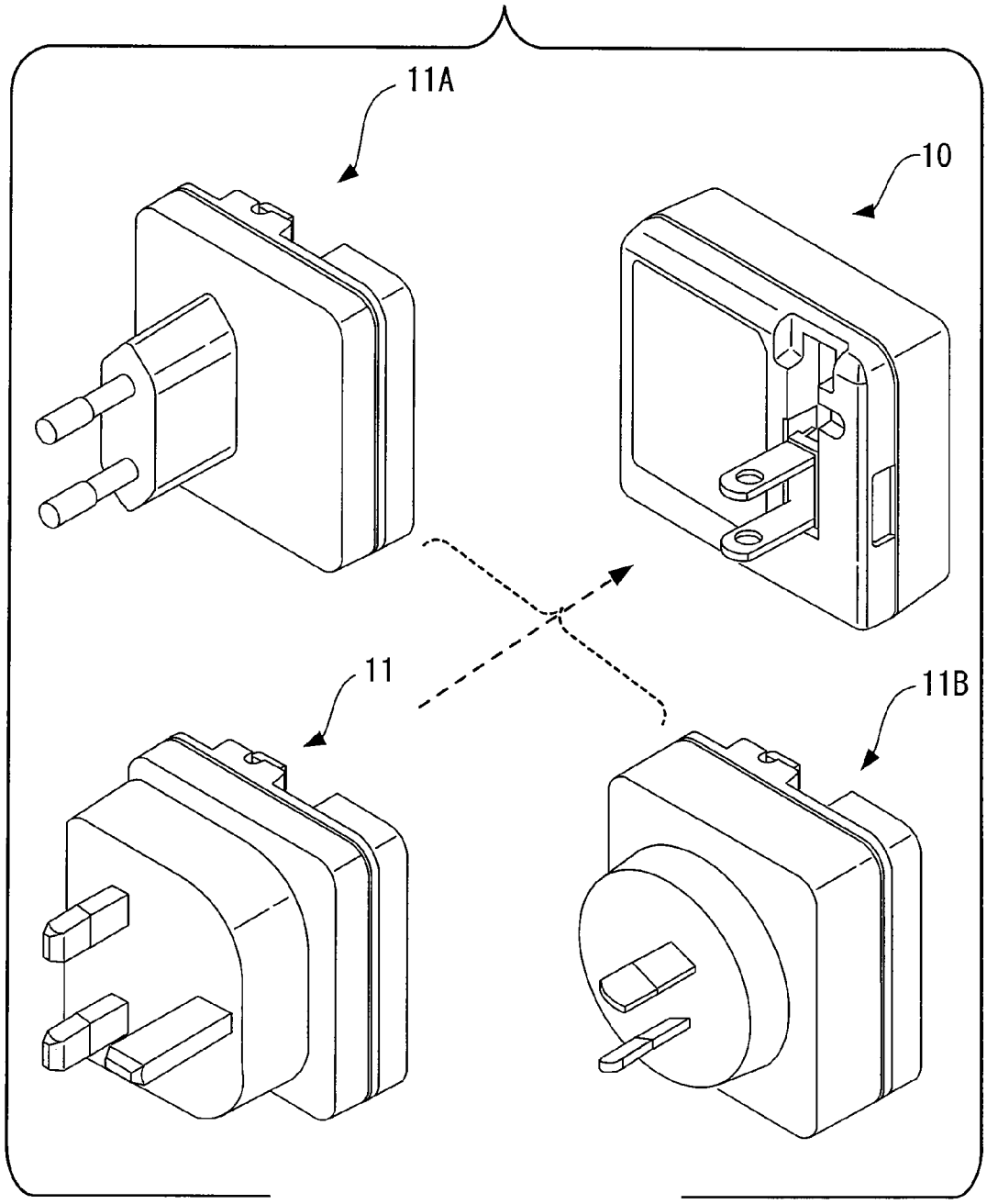
FIG. 1 is a diagram illustrating plural kinds of conversion plugs 11, 11A, and 11B to be plugged in outlets respectively having different specifications, and an attachment plug 10 for use in Japan.

FIG. 1 illustrates plural kinds of conversion plugs 11, 11A, and 11B to be plugged in outlets respectively having different specifications, and an attachment plug 10 for use in Japan. The conversion plugs 11, 11A, and 11B are suitable respectively for the specifications of three different destinations. Any of the conversion plugs 11, 11A, and 11B is inserted into, coupled to, and fixed to the attachment plug 10 for use in Japan to form a plug assembly. Hereinafter, the attachment plug 10 will be described as an attachment plug to be plugged in an outlet having a first specification for use in Japan, while the conversion plug 11 will be described as a conversion plug to be plugged in an outlet having a second specification.

At first, description will be made on the attachment plug 10 for use in Japan that is an example of the attachment plug of the present invention, which is to be plugged in an outlet having the first specification.

FIGS. 2A to 4 illustrate external appearances of the attachment plug 10.

Figure 2A:
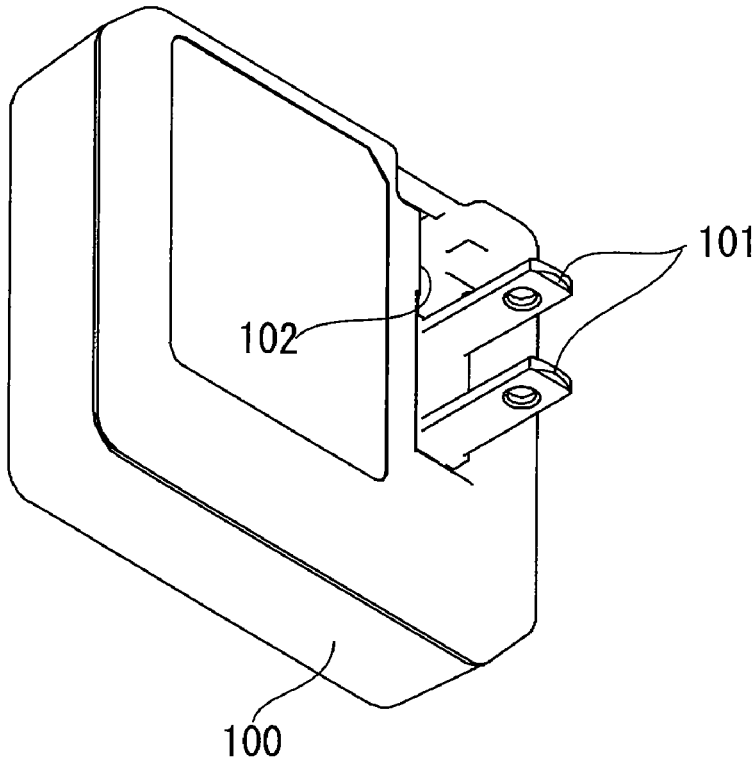
FIGS. 2A and 2B are diagrams each illustrating an external appearance of the attachment plug 10.
Figure 2B:
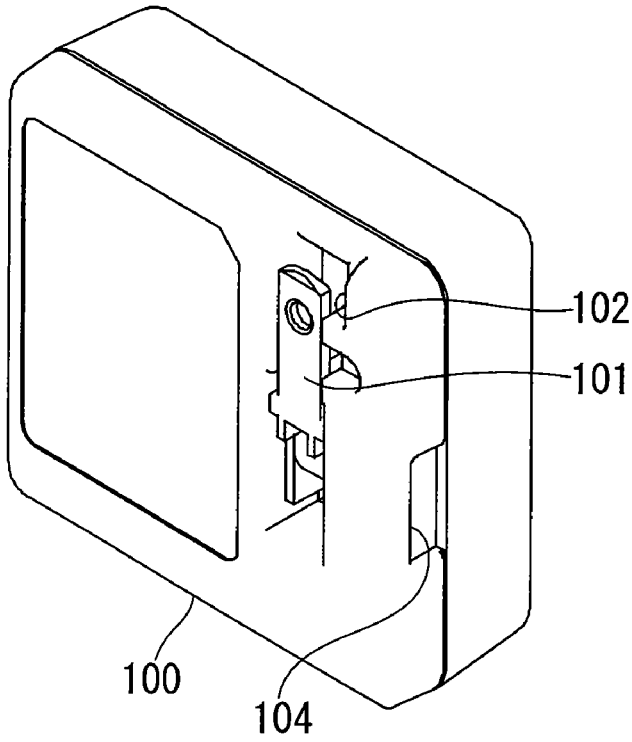
Figure 3:
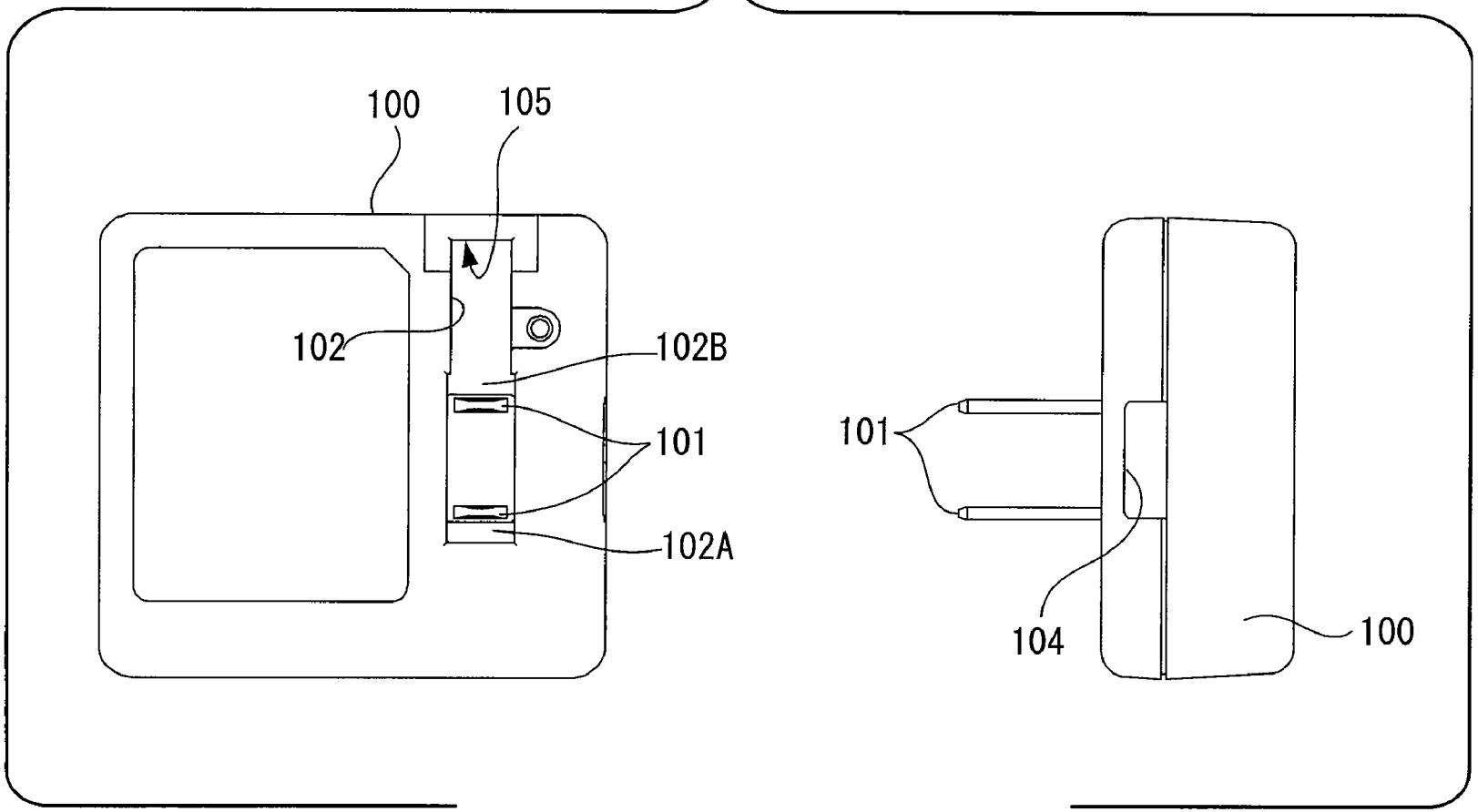
FIG. 3 is a diagram illustrating external appearances of the attachment plug 10.
Figure 4:
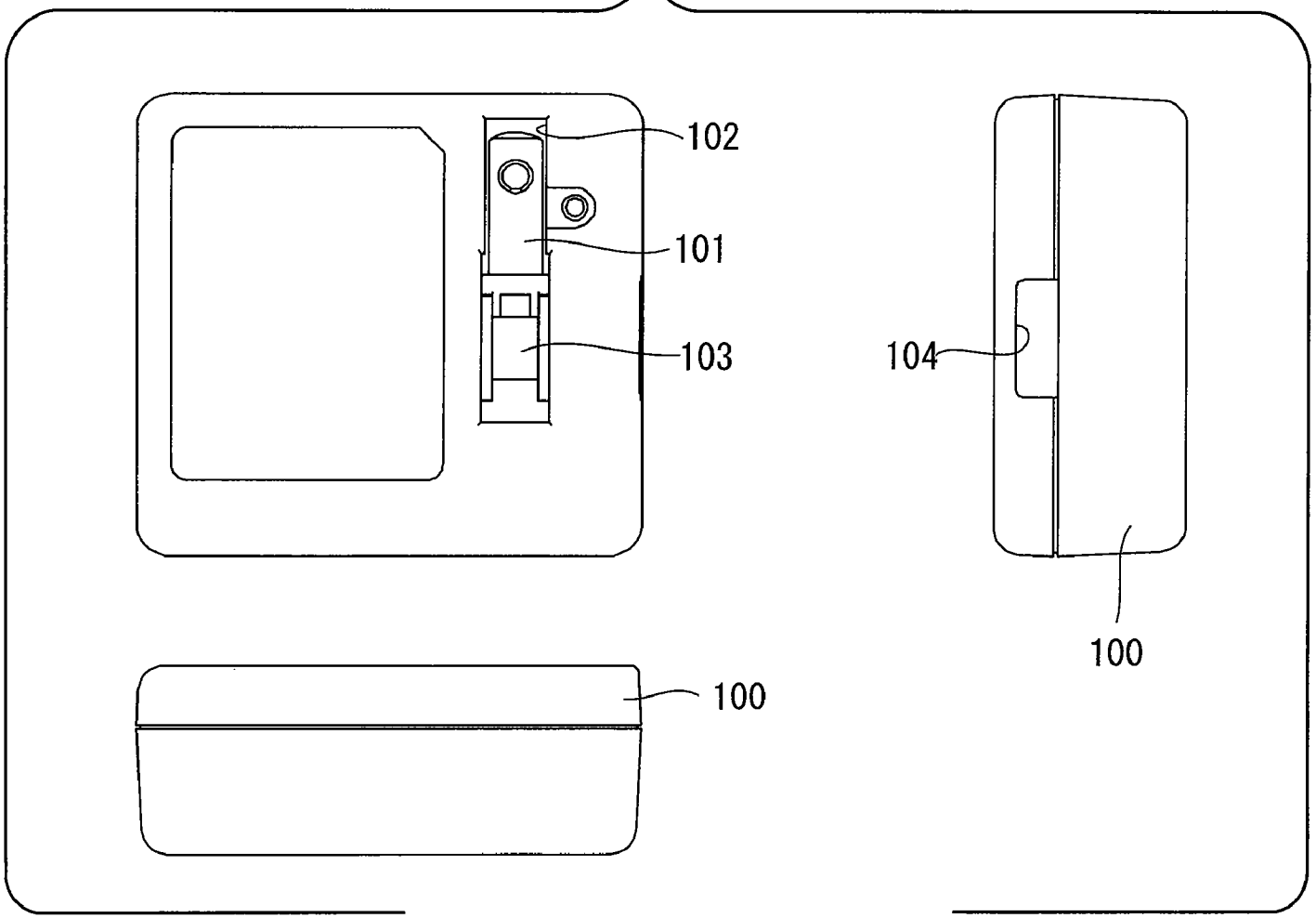
FIG. 4 is a diagram illustrating external appearances of the attachment plug 10.

FIG. 2A illustrates a pair of blades 101 in an erected state, while FIG. 2B illustrates the pair of blades 101 in a state of being housed in a storage channel 102. FIG. 3 illustrates a top view and a side view of the attachment plug 10 depicted in FIG. 2A. FIG. 4 illustrates a top view and side views of the attachment plug 10 depicted in FIG. 2B.

More specifically, FIG. 2A illustrates the attachment plug 10 to be plugged in an outlet having the first specification, i.e., the Japanese specification, having the pair of blades 101 facing each other in the erected state.

Further, the attachment plug 10 has a plug main body 100 in which the storage channel 102 is formed for housing the pair of blades 101 as illustrated in FIG. 3. The pair of blades 101 are supported by a blade support 103 as illustrated in FIG. 4, which supports one end of each of the blades 101 and is pivotably supported on the plug main body 100.

Thus, the pair of blades 101 swivel by 90 degrees, along a plane including the pair of blades 101, between the erected state (see FIG. 2A) and the state of being housed in the storage channel 102 (see FIG. 2B).

In addition, the storage channel 102 illustrated in FIG. 3 also serves as a recess 102B that is one of the pair of recesses for storage according to the present invention. The other recess 102A is formed on the other side across the pair of blades 101. When the conversion plug 11, which will be described later, is inserted into the attachment plug 10 to form a plug assembly, guide projections of the conversion plug 11 are respectively housed in the recesses 102A and 102B. In the present embodiment, there is described an example in which the structure of a plug assembly is simplified by using the storage channel 102 serving also as the recess 102B that is one of the pair of the recesses.

In addition, in order to secure engagement with the conversion plug 11, the plug main body 100 of the attachment plug 10 has a recess 104 (see FIG. 2A to FIG. 4) for retaining a projection 114 (see FIG. 5) formed in the conversion plug 11, which will be described later in detail. The recess 104 corresponds to an example of the plug-main-body engagement section of the plug main body according to the present invention. Incidentally, the plug main body 100 further has another recess, which will be described later in detail. This recess is a recess 105 provided at a sidewall of the storage channel 102 of the plug main body 100. The recess 105 shares the same concave with the storage channel 102 so that the structure is simplified.

Next, a structure of the conversion plug 11 illustrated in FIG. 1 will be described. The other conversion plugs 11A and 11B each have a structure similar to that of the conversion plug 11.

Figure 5:
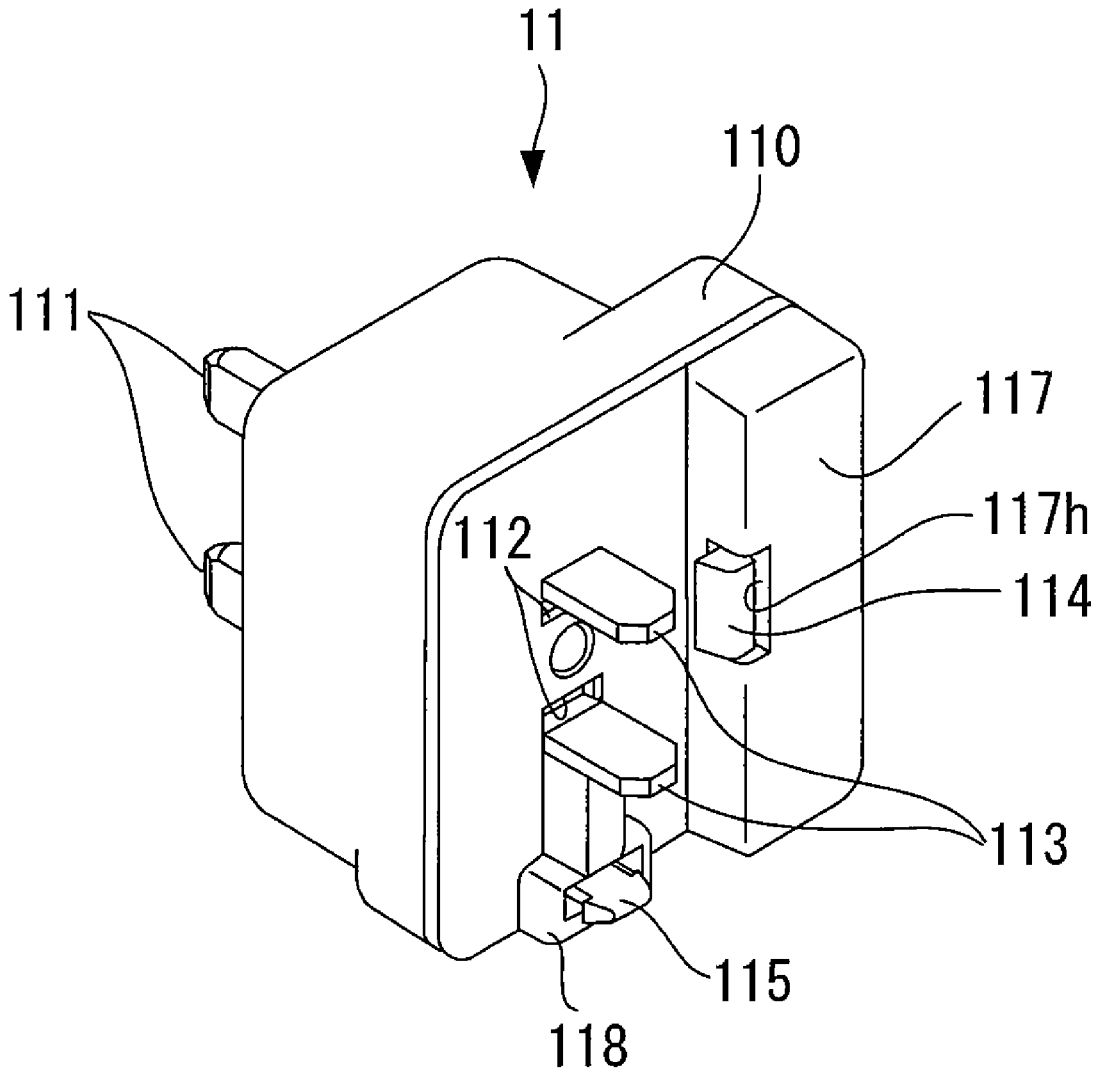
FIG. 5 is a diagram illustrating a structure of the conversion plug 11.
Figure 6:
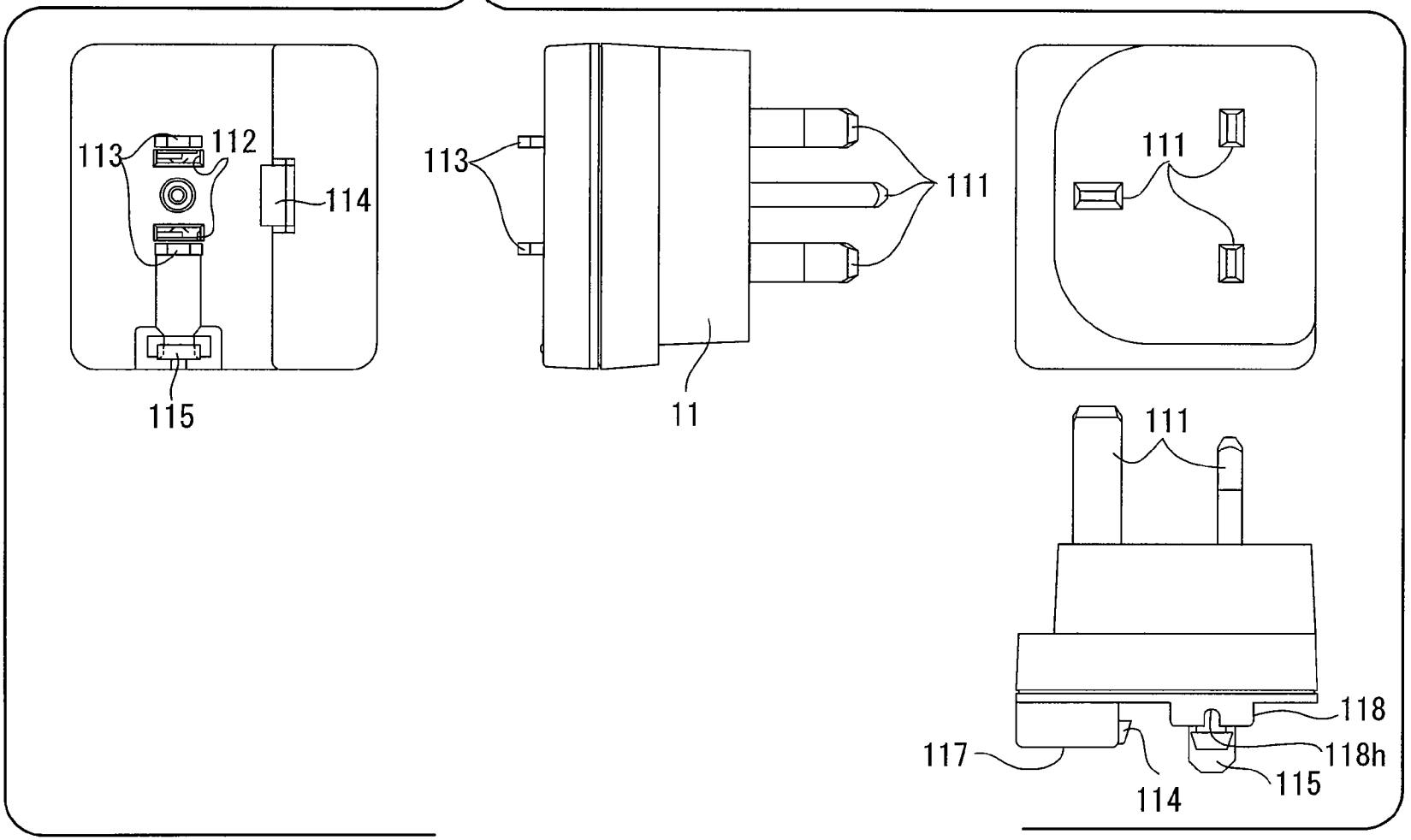
FIG. 6 is a diagram illustrating the structure of the conversion plug 11.
Figure 7:
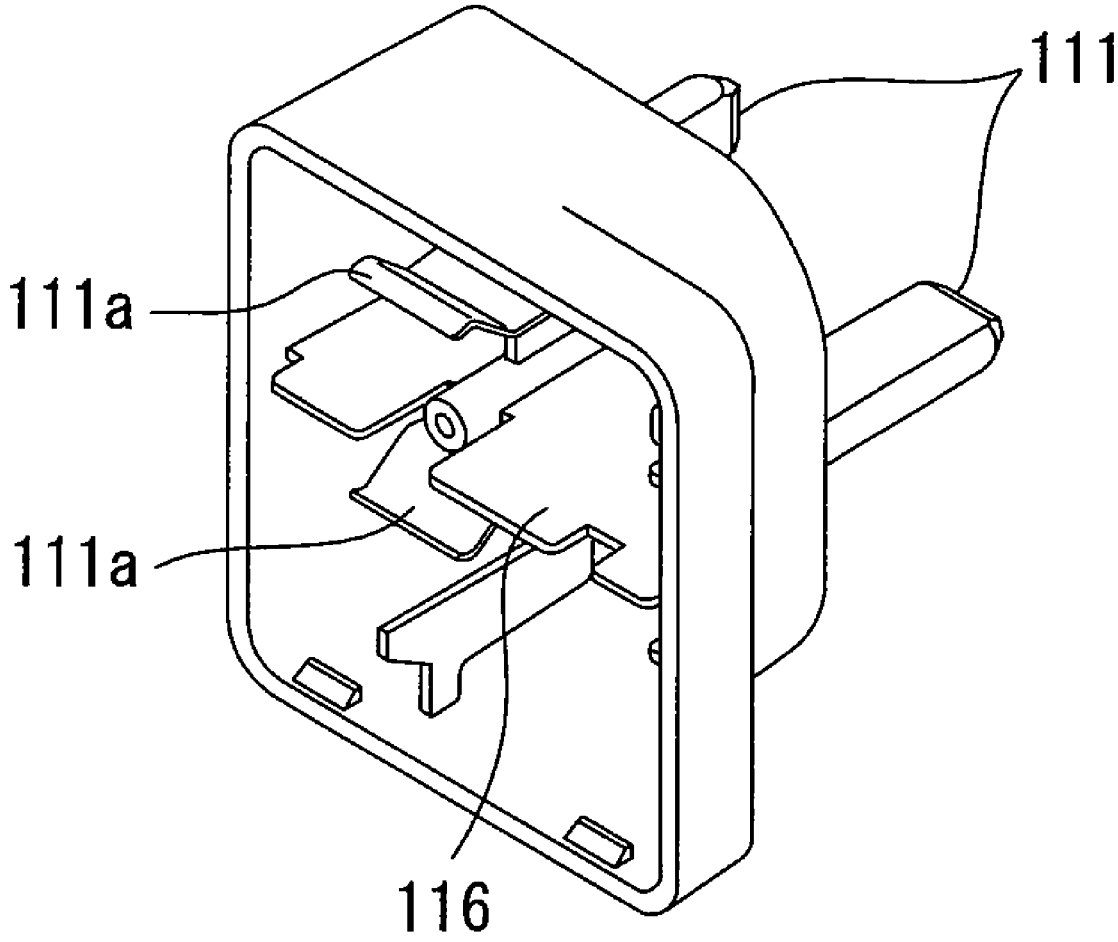
FIG. 7 is a diagram illustrating the structure of the conversion plug 11.
Figure 8:
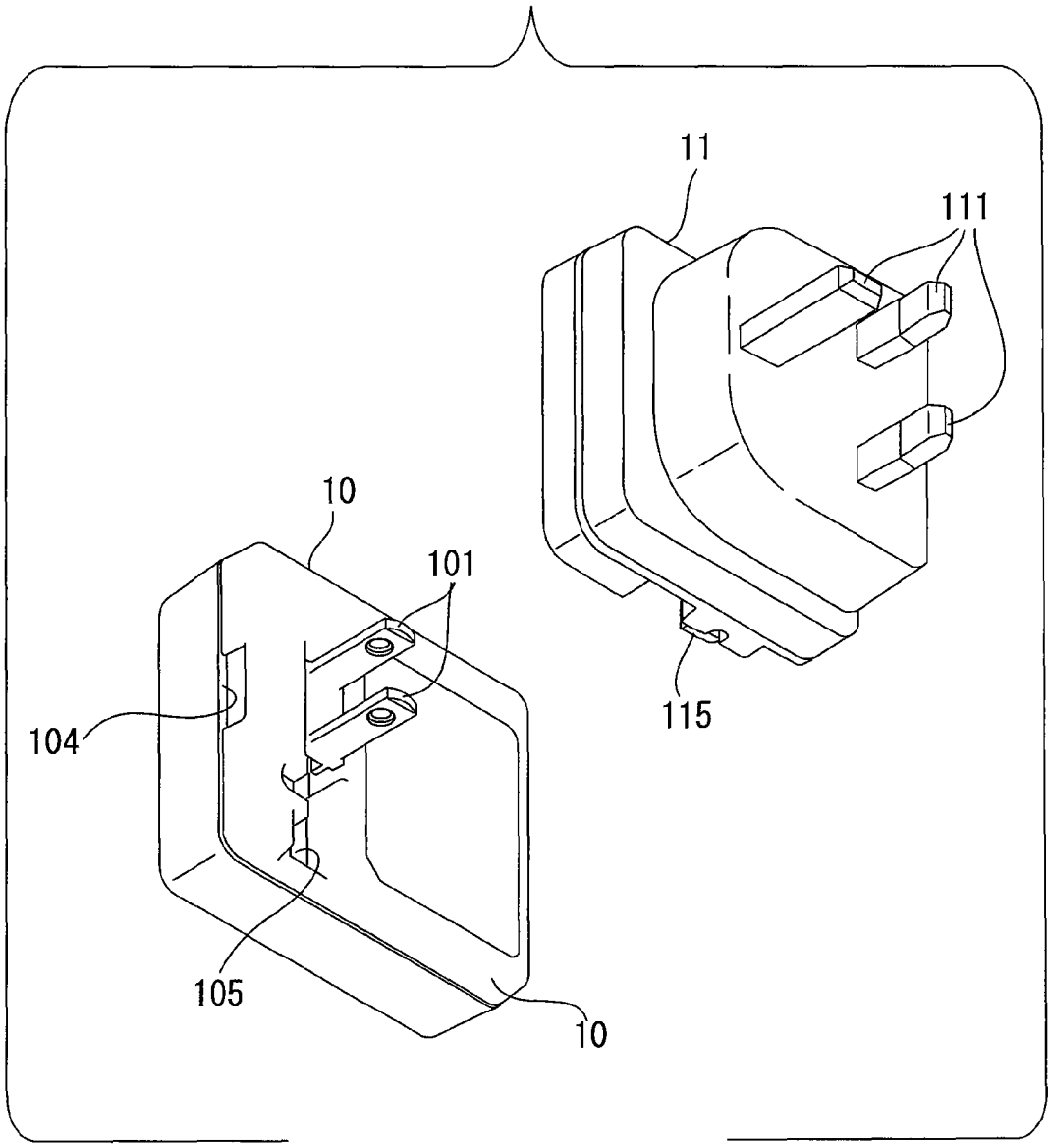
FIG. 8 is a diagram illustrating the structure of the conversion plug 11.
Figure 9:
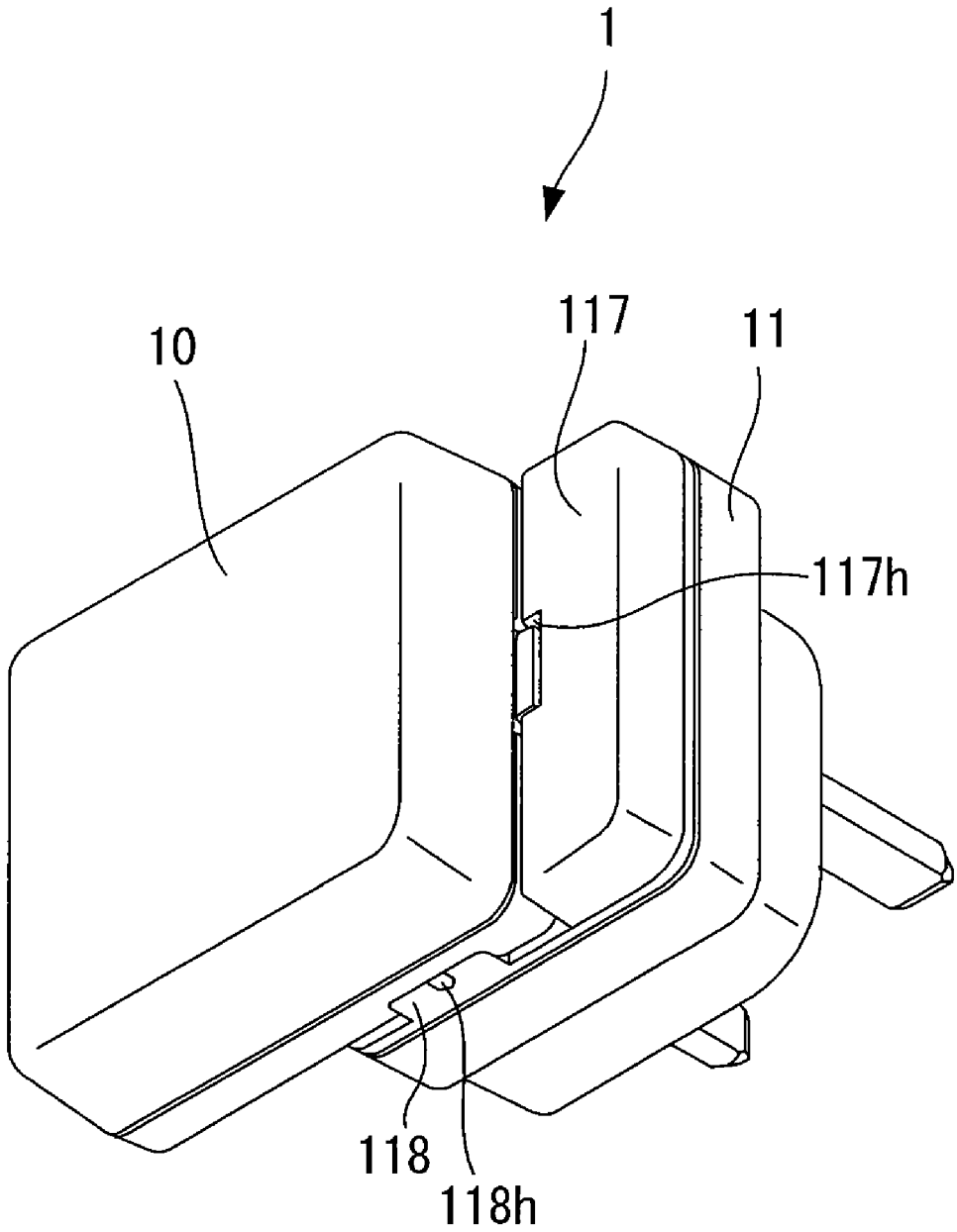
FIG. 9 is a diagram illustrating a plug assembly 1.

FIGS. 5 to 7 illustrate the structure of the conversion plug 11. FIG. 8 illustrates a state before the conversion plug 11 is inserted into the attachment plug 10. FIG. 9 illustrates a plug assembly 1 after the conversion plug 11 is inserted into the attachment plug 10.

FIG. 5 is a perspective view of the conversion plug 11 viewed from the attachment plug 10 into which the conversion plug 11 is to be inserted. FIG. 6 illustrates in the center thereof a front view of the conversion plug 11 in a state in which projections 111 are provided on a side. A left side view and a right side view are illustrated on both sides of the front view. Further, under the right side view, illustrated is a side view of the conversion plug 11 depicted in the right side view. FIG. 7 illustrates a rib 116 that is an element of the internal structure of the conversion plug 11.

Further, FIG. 8 illustrates that the plug assembly 1 is assembled when the conversion plug 11 illustrated in FIGS. 5 to 7 is inserted into the attachment plug 10. FIG. 9 illustrates the plug assembly 1 after the conversion plug 11 is coupled to the attachment plug 10.

The conversion plug 11 has, on one side thereof, plural insert projections 111 to be inserted into an outlet having a second specification that is different from the first specification. On the other side opposite to the one side where the projections 111 are provided, the conversion plug 11 has a pair of recesses 112 into which the pair of blades 101 in the erected state of the attachment plug 10 are to be inserted. By inserting the pair of blades 101 into the pair of recesses 112, the conversion plug 11 is coupled to the attachment plug 10.

Hereafter, the structure of the conversion plug 11 that is a feature of the present invention will be described in detail, referring to FIGS. 5 to 7.

As illustrated in FIGS. 5 to 6, the conversion plug 11 has guide projections 113 that hold the pair of blades 101 in the erected state interposed therebetween and guide them into the pair of recesses 112 at the time when the conversion plug 11 is coupled to the attachment plug 10. Each of the guide projections 113 has such a tapered shape that its tip is narrower than its root. For this reason, the respective opposed faces of the pair of guide projections 113 are slanted instead of being parallel to each other, and the space between the respective tips of the pair of guide projections 113 is wider than the space between the respective roots thereof.

The guide projections 113 restrict the attitude of the blades 101 when the conversion plug 11 is inserted into the attachment plug 10, and thus naturally guide the blades 101 of the attachment plug 10 to the recesses 112 formed in the conversion plug 11. This structure almost completely prevents exertion of unnecessary force on the blades 101 when the conversion plug 11 is coupled to the attachment plug 10 by an operator. Further, since the space between the respective tips of the pair of guide projections 113 is wide, the blades 101 of the attachment plug 10 are readily positioned between the pair of guide projections 113 and guided to the appropriate positions as the blades 101 are inserted, which reduces backlash.

As illustrated in FIG. 3, the plug main body 100 has the recesses 102A and 102B formed in positions respectively adjacent to the pair of blades 101 in the erected state. The recesses 102A and 102B accommodate the pair of guide projections 113 of the conversion plug 11 illustrated in FIGS. 5 and 6.

Thus, after the conversion plug 11 is coupled to the plug main body 100 of the attachment plug 10, the guide projections 113 are accommodated in the recesses 102A and 102B so that the guide projections 113 cover and protect the pair of blades 101. As a result, the guide projections 113 reinforce the strength in the periphery of the blades 101 by serving as a wall, thereby preventing deformation of the blades 101 even when external force is applied thereto due to fall or collision.

When the conversion plug 11 is unexpectedly disengaged from the attachment plug 10, the pair of guide projections 113 prevent another product's blades in the same shape as that of the pair of the blades 101 from being wrongly inserted into the conversion plug 11. Thus, in addition to the guiding and protecting functions described above, the guide projections 113 have the function of preventing a failure by unexpected use.

Further, a case 110 of the conversion plug 11 is formed by elastic resin or the like as illustrated in FIG. 5 and has the projection 114 and a projection 115 formed in two separate positions thereof that are respectively engaged in the recess 104 (see FIG. 3) and the recess 105 formed in the plug main body 100 of the attachment plug 10. When the projections 114 and 115 are engaged in the recesses 104 and 105 formed in the plug main body 100 of the attachment plug 10 with elastic deformation, the conversion plug 11 is firmly coupled to the plug main body 100 of the attachment plug 10. The projection 115 is provided on an extension line of the line along the direction in which the pair of guide projections 113 are aligned. Also, corresponding to this projection 115, the recess 105 illustrated in FIG. 3 is provided on an extension line of the line along the direction in which the pair of guide projections 113 are aligned. Therefore, even when a twisting force is exerted in a state that the conversion plug 11 is coupled to the attachment plug 10, deformation of the blades 101 and removal of the attachment plug 10 are prevented. The projections 114 and 115 are examples of the conversion-plug engagement section according to the present invention.

Further, the case 110 of the conversion plug 11 is provided with a surrounding part 117 that surrounds the projection 114 and a surrounding part 118 that surrounds the projection 115. The surrounding part 117 has a jig insertion part 117*h* formed by an indentation, while the surrounding part 118 has a jig insertion part 118*h* as illustrated in FIG. 6. The details of the jig insertion parts 117*h* and 118*h* will be described later.

Furthermore, as illustrated in FIG. 7, the rib 116 is formed inside the conversion plug 11. The rib 116 serves as a partition to prevent short circuit of the two parallel projections 111 that are conductive members to receive electricity.

In this way, the conversion plug 11 is coupled to the attachment plug 10 so that they form the plug assembly 1 as illustrated in FIG. 9.

According to the structure illustrated in FIG. 9, as compared with the technique disclosed in U.S. Pat. No. 5,613,863, the amount of deviation of the conversion plug 11 toward one side of the attachment plug 10 is suppressed to be small so that the attachment plug 10 and the conversion plug 11 are integrated. Thus, even if the plug assembly 1 illustrated in FIG. 9 is dropped or hit against a wall when in use, moment applied to the pair of blades 101 of the attachment plug 10 is suppressed to be small, thereby preventing deformation of the blades 101.

Lastly, there will be described a structure of an engagement section that reinforces coupling between the conversion plug 11 and the attachment plug 10 after the conversion plug 11 is coupled to the attachment plug 10. In addition, a structure of a conductive section that carries electricity from an outlet having a different specification to the pair of blades 101 will also be described.

Figure 10:
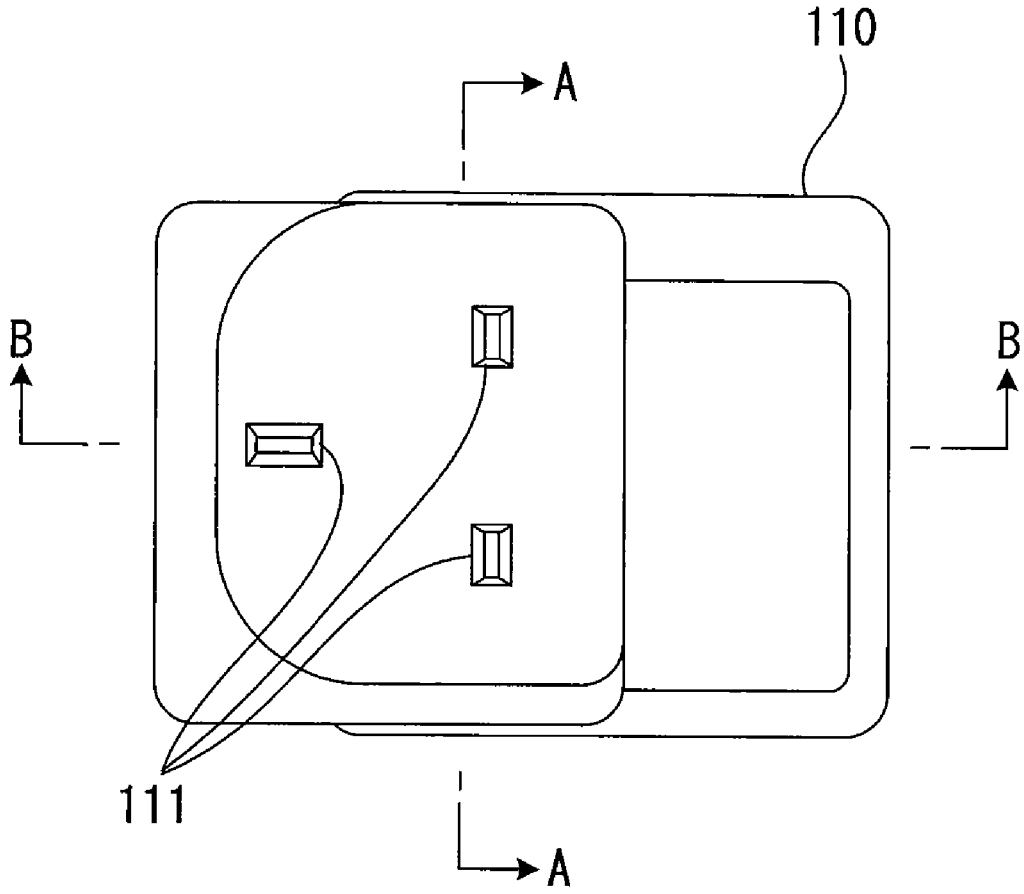
FIG. 10 is a diagram illustrating the plug assembly 1 depicted in FIG. 9 as viewed from a side where plural projections 111 of the conversion plug are provided.

FIG. 10 illustrates the plug assembly 1 depicted in FIG. 9 as viewed from the side where the plural projections, i.e., the three projections 111 according to the present embodiment, of the conversion plug 11 are provided. FIG. 10 also illustrates lines A-A and B-B for taking cross-sectional views.

Figure 11B:
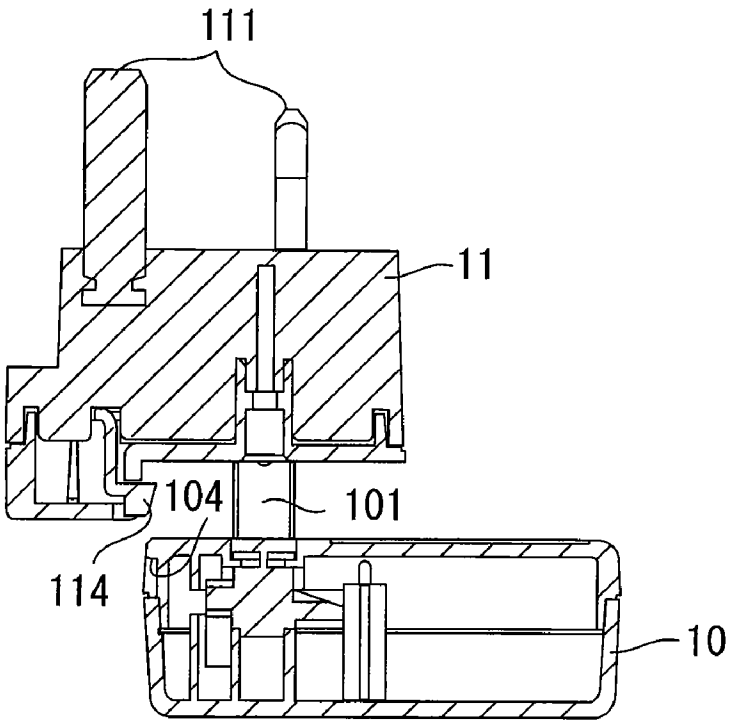
FIG. 11A and FIG. 11B are diagrams illustrating internal structures before the conversion plug 11 is inserted into a plug main body 100 of the attachment plug 10 to form the plug assembly 1.
Figure 11A:
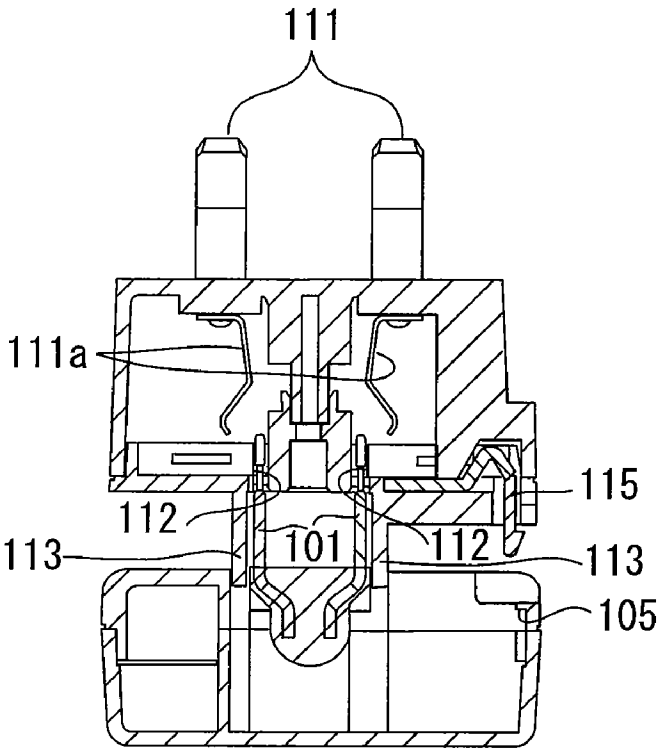

FIG. 11A and FIG. 11B illustrate internal structures of the conversion plug 11 and the attachment plug 10 before the conversion plug 11 is coupled to the plug main body 100 of the attachment plug 10 to form the plug assembly 1. FIG. 11A illustrates a cross-sectional view taken along the line A-A and FIG. 11B illustrates a cross-sectional view taken along the line B-B.

Figure 12B:
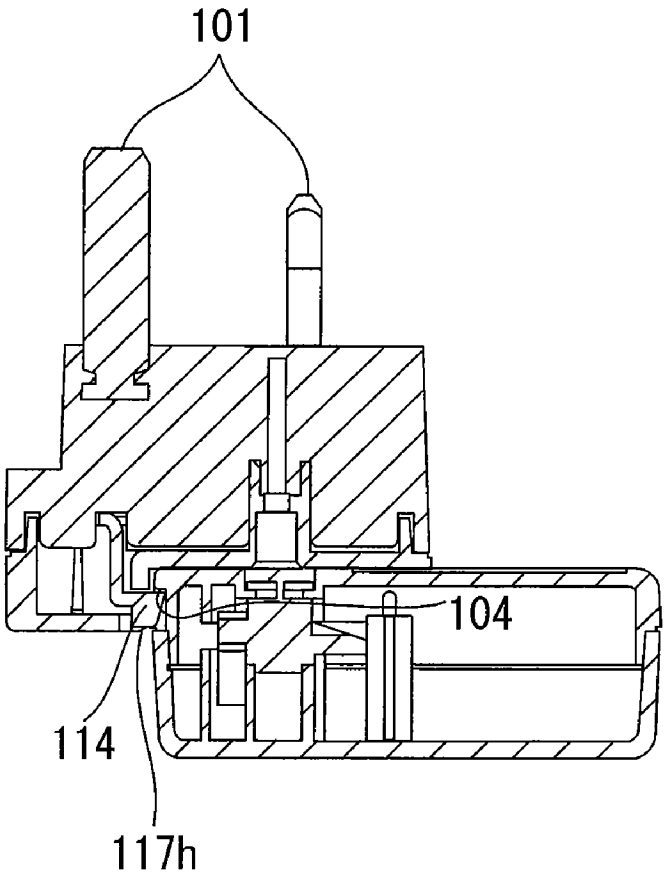
FIG. 12A and FIG. 12B are diagrams illustrating internal structures after the plug assembly 1 is formed by inserting the conversion plug 11 into the plug main body 100 of the attachment plug 10.
Figure 12A:
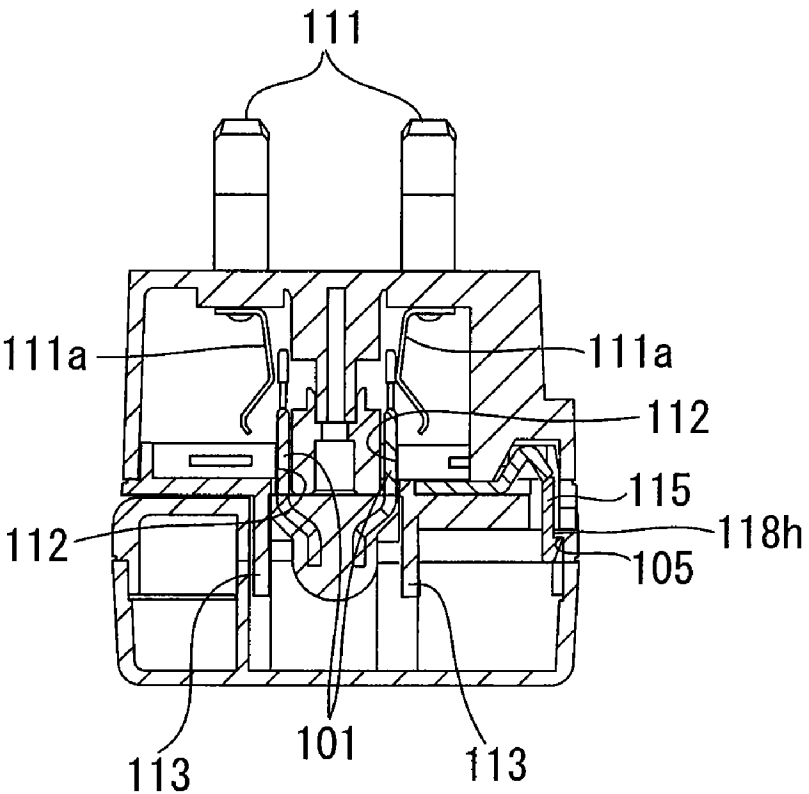

FIG. 12A and FIG. 12B illustrate internal structures of the conversion plug 11 and the attachment plug 10 after the plug assembly 1 is formed by inserting the conversion plug 11 into the plug main body 100 of the attachment plug 10.

FIG. 12A illustrates a cross-sectional view taken along the line A-A and FIG. 12B illustrates a cross-sectional view taken along the line B-B.

Firstly, by referring to the cross-sectional view taken along the line A-A and the cross-sectional view taken along the line B-B as well as FIGS. 11A and 12A, the internal states of the conversion plug 11 and the attachment plug 10 before the plug assembly 1 is assembled will be described.

As illustrated in FIGS. 11A and 12A, one side (the upper side in the drawing) of the conversion plug 11 has the projections 111 to be inserted into an outlet having a second specification, and the other side (opposite to the side where the projections are provided) of the conversion plug 11 has the recesses 112 into which the pair of blades 101 of the attachment plug 10 are inserted. The plug assembly 1 is assembled by inserting the pair of blades 101 of the attachment plug 10 into the recesses 112.

The conversion plug 11 and the plug main body 100 of the attachment plug 10 respectively have the projections 114, 115 and the recesses 104, 105 that are mutually engaged when the conversion plug 11 is coupled to the attachment plug 10. The projections 114, 115 are examples of the conversion-plug engagement section according to the present invention, and the recesses 104, 105 are examples of the plug-main-body engagement section of according to the present invention. Before the conversion plug 11 is coupled to the attachment plug 10, no change appears in these projections and recesses as illustrated in FIGS. 11A and 11B. In addition, in the states illustrated in FIGS. 11A and 11B, there is no change in the conductive members 111*a* of the conversion plug 11, which extend from the plural projections 111 toward the inside of the conversion plug 11, and in the blades 101 of the attachment plug 10. In other words, the conductive members 111*a* are not in contact with the blades 101.

Subsequently, when the conversion plug 11 is inserted into the attachment plug 10 by an operator to assemble the plug assembly, the blades 101 are naturally guided by the guide projections 113 to the recesses 112 as described above. When the conversion plug 11 is completely inserted into the attachment plug 10 by the operator, the conversion plug 11 and the attachment plug 10 are securely coupled to each other as illustrated in FIGS. 12A and 12B.

When the conversion plug 11 is completely inserted into the attachment plug 10 in this way, as illustrated in FIGS. 12A and 12B, the projections 114, 115 of the conversion plug 11 are respectively engaged in the recesses 104, 105 of the attachment plug 10 so that the conversion plug 11 and the plug main body 100 of the attachment plug 10 are firmly coupled to each other.

Further, during the process in which the conversion plug 11 is inserted into the attachment plug 10, the conductive members 111*a* in a plate-spring shape are pushed to be separated from each other outwardly as the blades 101 are inserted further into the recesses 112. When the blades 101 are fully inserted into the recesses 112, the plate-spring-shaped conductive members 111*a* contact the sides of the blades 101 while pushing these sides to carry electricity from the outlet having the second specification to the blades 101. The plug assembly 1 is assembled in this manner.

The plug assembly 1 assembled in the manner as described above almost completely prevents deformation of the blades 101 even when a user drops the plug assembly during use, for the following two reasons: the guide projections 113 protect the blades 101; and the amount of deviation of the conversion plug 11 with respect to the plug main body 100 of the attachment plug 10 is suppressed to be small so that the conversion plug 11 and the attachment plug 10 are integrated.

Further, in the plug assembly 1 after being assembled, as illustrated in FIG. 9, the projections 114 and 115 are covered with the surrounding parts 117 and 118 and the conversion plug 11. At the time of repair, engagement of the projections 114 and 115 in the recesses 104 and 105 is released by inserting a thin-stick-like jig into the jig insertion parts 117*h* and 118*h*. This avoids such a situation that the attachment plug 10 is disengaged from the conversion plug 11 due to an intentional touch on the projections 114 and 115 by a user.

As described above, it is possible to realize, at low cost, a plug assembly having blades that are free from deformation both during assembly and when in use, and an attachment plug and a conversion plug forming the plug assembly.

What is claimed is:

1. A plug assembly comprising:

an attachment plug that comprises a pair of blades projecting while facing each other and plugged in an outlet of a first specification, a plug main body having a storage channel for housing the pair of blades, and a blade support that supports one end of each of the pair of blades and is pivotably supported by the plug main body to rotate, along a plane including the pair of blades by approximately 90 degrees, between a stand state in which the pair of blades stand from the plug main body and a stored state in which the pair of blades are engaged in the storage channel; and a conversion plug that comprises a plurality of insert projections plugged in an outlet of a second specification different from the first specification and a pair of recesses into which the pair of blades in the stand state are inserted, the insert projections carrying electricity received from the outlet of the second specification to the pair of blades when the pair of blades are inserted into the pair of recesses and, wherein the conversion plug further comprises a pair of guide projections that hold therebetween the pair of blades in the stand state when the conversion plug is coupled to the attachment plug and guide the pair of blades into the pair of recesses, wherein the plug main body has, at positions respectively adjacent to the pair of blades in the stand state, a pair of storage recesses for housing the pair of guide projections, wherein the storage channel is also used as one of the pair of storage recesses.

2. The plug assembly according to claim 1, wherein the conversion plug and the plug main body have a conversion-plug engagement section and a plug-main-body engagement section, respectively, which engage with each other when the conversion plug is coupled to the attachment plug.

3. The plug assembly according to claim 2, wherein the plug-main-body engagement section is a recess that is also used as the storage channel, and the conversion-plug engagement section is a projection that is engaged in the recess, which is used as the plug-main-body engagement section and the storage channel, and that is provided on an extension line extending in a direction in which the pair of guide projections is aligned.

4. The plug assembly according to claim 1, wherein the pair of blades in the stand state is positioned between the pair of storage recesses, and is held between the pair of guide projections which are being housed in the pair of storage recesses.

5. The plug assembly according to claim 1, wherein each of the guide projections has a tapered shape in which a tip of the each of the guide projections is narrower than a root of the each of the guide projections.

6. An attachment plug comprising:

a pair of blades projecting while facing each other and plugged in an outlet of a first specification;

a plug main body having a storage channel for housing the pair of blades; and a blade support that supports one end of each of the pair of blades and is pivotably supported by the plug main body to rotate, along a plane including the pair of blades by approximately 90 degrees, between a stand state in which the pair of blades stand from the plug main body and a stored state in which the pair of blades are engaged in the storage channel, wherein the attachment plug is engaged with a conversion plug that has a plurality of insert projections plugged in an outlet of a second specification different from the first specification, a pair of recesses into which the pair of blades in the stand state are inserted, and a pair of guide projections that hold therebetween the pair of blades in the stand state when the conversion plug is coupled to the attachment plug and guide the pair of blades into the pair of recesses, and when the plurality of insert projections are plugged in the outlet of the second specification in a state in which the pair of blades are inserted into the pair of recesses, the insert projections carry electricity received from the outlet of the second specification to the pair of blades, wherein the plug main body has, at positions respectively adjacent to the pair of blades in the stand state, a pair of storage recesses for housing the pair of guide projections, wherein the storage channel is also used as one of the pair of storage recesses.

7. A conversion plug that is coupled to an attachment plug that has a pair of blades projecting while facing each other and plugged in an outlet of a first specification, a plug main body having a storage channel for housing the pair of blades, and a blade support that supports one end of each of the pair of blades and is pivotably supported by the plug main body to rotate, along a plane including the pair of blades by approximately 90 degrees, between a stand state in which the pair of blades stand from the plug main body and a stored state in which the pair of blades are engaged in the storage channel, the conversion plug receiving electricity from an outlet of a second specification different from the first specification and carrying the electricity to the pair of blades, the conversion plug comprising:

a plurality of insert projections plugged in an outlet of a second specification different from the first specification, a pair of recesses into which the pair of blades in the stand state are inserted, and a pair of guide projections that hold therebetween the pair of blades in the stand state when the conversion plug is coupled to the attachment plug and guide the pair of blades into the pair of recesses, wherein the storage channel is also used as one of the pair of storage recesses.

* * * * *